United States Patent [19]

Hatakeyama et al.

[11] Patent Number: 4,994,353

[45] Date of Patent: Feb. 19, 1991

[54] SILVER HALIDE PHOTOGRAPHIC MATERIAL HAVING POLYESTER SUPPORT WITH SUBBING LAYER

[75] Inventors: Akira Hatakeyama; Takashi Naoi, both of Kanagawa; Sumio Nishikawa, Shizuoka, all of Japan

[73] Assignee: Fuji Photo Film Co., Ltd., Kanagawa, Japan

[21] Appl. No.: 538,452

[22] Filed: Jun. 15, 1990

[30] Foreign Application Priority Data

Jun. 15, 1989 [JP] Japan ..... 1-152931
Sep. 18, 1989 [JP] Japan ..... 1-240965

[51] Int. Cl.[5] ..... G03C 1/00

[52] U.S. Cl. ..... 430/496; 430/533; 430/534; 430/535

[58] Field of Search ..... 430/496, 633, 501, 935, 430/534, 535

[56] References Cited

U.S. PATENT DOCUMENTS 4,933,267 6/1990 Ishigahi et al. ..... 430/533

*Primary Examiner*—Jack P. Brammer
*Attorney, Agent, or Firm*—Sughrue, Mion, Zinn, Macpeak & Seas

[57] ABSTRACT

A silver halide photographic material is described composed of a polyester support having a hydrophilic colloidal layer containing a polymer latex on at least one side thereof, wherein the polyester support has a subbing layer having a thickness of 0.3 μm or more and containing a vinylidene chloride copolymer composed of at least (1) from 70 to 99.9% by weight of a vinylidene chloride monomer and (2) from 0.1 to 5% by weight of a vinyl monomer having at least one carboxyl group, the subbing layer further containing a compound represented by formula (I) or (II):

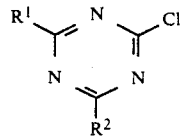

(I)

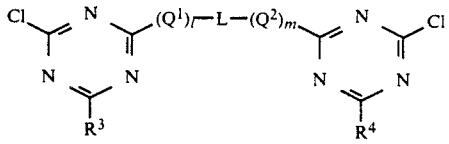

(II)

wherein $R^1$, $R^2$, $R^3$, and $R^4$ each represents a chlorine atom, a hydroxyl group, an alkyl group, an alkoxy group, an alkylthio group, —OM (wherein M represents a monovalent metal atom), —NR'R'', or —NHCOR''' (wherein R', R'', and R''' each represents a hydrogen atom, an alkyl group, or an aryl group); $Q^1$ and $Q^2$ each represents —O—, —S—, or —NH—; L represents a divalent linking group selected from an alkylene group, an arylene group, and a combination thereof; and l and m each represents 0 or 1.

The silver halide photographic material has excellent dimensional stability and improved adhesion between a support and a photographic layer provided thereon.

20 Claims, No Drawings

SILVER HALIDE PHOTOGRAPHIC MATERIAL HAVING POLYESTER SUPPORT WITH SUBBING LAYER

FIELD OF THE INVENTION

The present invention relates to a silver halide photographic material, and more particularly to a silver halide photographic material having excellent dimensional stability and improved adhesion between a support and a photographic layer provided on the support.

BACKGROUND OF THE INVENTION

A silver halide photographic material generally has a photographic layer containing a hydrophilic colloid as a binder and therefore undergoes dimensional changes due to elongation and shrinkage of the photographic layer with temperature and humidity variations. Such dimensional changes are an extremely serious drawback for silver halide photographic materials which are required to reproduce dot images or minute line images with fidelity for multicolor printing.

Various means have previously been used in an attempt to improve the dimensional stability of silver halide photographic materials. For example, U.S. Pat. No. 3,201,250 discloses a technique in which a thickness ratio of a hydrophilic colloidal layer to a support is specified. The addition of a polymor latex to a hydrophilic colloid photographic layer has also been described, as disclosed in JP-B-39-4272, JP-B-39-17702, JP-B-43-13482, and JP-B-45-5331 (the term "JP-B" as used herein means an "examined published Japanese patent application"), and U.S. Pat. Nos. 2,376,005, 2,763,625, 2,772,166, 2,852,386, 2,853,457, 3,397,988, 3,411,911, and 3,411,912.

The dimensional stability of silver halide photographic materials against temperature and humidity variations can be improved by these techniques. However, it is impossible for these techniques to prevent dimensional changes of silver halide photographic materials due to development processing. The dimensional change due to development processing is a phenomenon in which a photographic material becomes elongated due to water absorption in the support during development processing but is not restored to its original dimension by drying. As a result, the dimensions of the material differ between before and after the development processing. In the art, this phenomenon is called "poor dimensional stability with processing" and is an extremely serious disadvantage, particularly for silver halide photographic materials for printing.

In order to improve dimensional stability with processing, the use of a subbing layer containing a vinylidene chloride copolymer has been suggested, as disclosed in JP-A-64-538 (the term "JP-A" as used herein means an "unexamined published Japanese patent application"). According to this technique, although dimensional stability with processing can be improved, adhesion between a support and the subbing layer is insufficient. To eliminate this disadvantage, it has been necessary to incorporate a swellinq agent for a support into the subbing layer or to subject the support surface to a powerful pre-treatment, such as a glow discharge.

For a polyester support, suitable swelling agents include phenol, resorcin, o-cresol, m-cresol, trichloroacetic acid, dichloroacetic acid, monochloroacetic acid, chloral hydrate, and benzyl alcohol, with resorcin being the most preferred.

However, resorcin frequently causes spot disorders during the preparation of silver halide photographic materials.

Moreover, a glow discharge treatment of a polyester support must be carried out in a vacuum of about 1 Torr, which is not only complicated but also disadvantageous from an economic standpoint.

Further, JP-A-63-122537 teaches the formation of a primer layer comprising an aqueous melamine compound, an aqueous epoxy compound, an aqueous aziridine compound or a polyvalent metal-crosslinked vinylidene resin on a polyester film support. According to this method, however, sufficient adhesion between a silver halide photographic emulsion layer and a polyester support, particularly in a wet state, cannot be obtained, or the effect of improving dimensional stability with processing is impaired.

Hence, there has been a demand for a technique of improving adhesion between a polyester support and a silver halide photographic emulsion layer without being accompanied by the above-described disadvantages.

SUMMARY OF THE INVENTION

An object of the present invention is to provide a silver halide photographic material having improved dimensional stability with processing.

Another object of the present invention is to provide a silver halide photographic material having an improved adhesion between a polyester support and a vinylidene chloride subbing layer without the aid of a polyester swelling agent, e.g., resorcin, or a complicated pre-treatment, e.g., a glow discharge treatment.

It has now been found that the objects of the present invention are accomplished by a silver halide photographic material comprising a polyester support having a hydrophilic colloidal layer containing a polymer latex on at least one side thereof, wherein the polyester support has a subbing layer having a thickness of 0.3 μm or more and containing a vinylidene chloride copolymer composed of at least (1) from 70 to 99.9% by weight of a vinylidene chloride monomer and (2) from 0.1 to 5% by weight of a vinyl monomer having at least one carboxyl group, the subbing layer further containing a compound represented by formula (I) or (II):

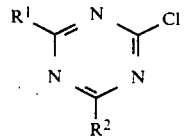

(I)

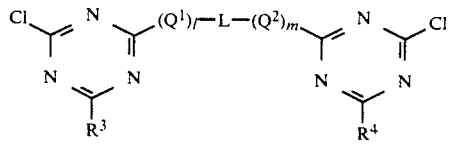

(II)

wherein $R^1$, $R^2$, $R^3$, and $R^4$ (which may be the same or different) each represents a chlorine atom, a hydroxyl group, an alkyl group, an alkoxy group, an alkylthio group, —OM (wherein M represents a monovalent metal atom), —NR'R'' or —NHCOR''' (wherein R', R'', and R''' each represents a hydrogen atom an alkyl group, or an aryl group); $Q^1$ and $Q^2$ each represents —O—, —S—, or —NH—; L represents a divalent linking group selected from an alkylene group, an arylene group, and a combination thereof; and l and m each represents 0 or 1.

DETAILED DESCRIPTION OF THE INVENTION

The vinylidene chloride copolymer which can be used in the present invention contains from 70 to 99.9% by weight, and preferably from 85 to 99% by weight, of vinylidene chloride.

The vinylidene chloride copolymer may also contain a monomer copolymerizable with vinylidene chloride Examples of such a monomer include acrylonitrile, methacrylonitrile, methyl acrylate, ethyl acrylate, butyl acrylate, methyl methacrylate, butyl methacrylate, glycidyl methacrylate, 2-hydroxyethyl methacrylate, vinyl acetate, acrylamide, methacrylamide, methylmethacrylamide, methyl vinyl ether, and styrene. These monomers may be used either individually or in combination of two or more thereof.

Examples of the vinyl monomer having at least one carboxyl group which can be used in the vinylidene chloride copolymer include acrylic acid, methacrylic acid, itaconic acid, and citraconic acid. Of these, acrylic acid and methacrylic acid are particularly preferred.

The vinylidene chloride copolymer of the present invention is preferably an aqueous dispersion of a latex, including not only general latices having a uniform structure but so-called core-shell type latices having different structures between the core and the shell of the latex particles.

Specific examples of the vinylidene chloride copolymer according to the present invention are shown below Ratios in the parentheses are based on percents by weight.

V-1: Vinylidene chloride/acrylic acid/methyl acrylate (90:1:9)

V-2: Vinylidene chloride/acrylic acid/methyl methacrylate (90:1:9)

V-3: Vinylidenechloride/methacrylicacid/methylmethacrylate (90:0.5:9.5)

V-4: Vinylidene chloride/methacrylic acid/ethyl acrylate/methyl methacrylate (90:0.5:5:4.5)

V-5: Vinylidene chloride/acrylic acid/methyl acrylate/methyl methacrylate (90:0.5:5:4.5)

V-6: Vinylidene chloride/acrylic acid/methyl methacrylate/acrylonitrile (90:0.3:8:1.7)

V-7: Vinylidene chloride/methacrylic acid/methyl methacrylate/methacrylonitrile (80:3:10:7)

V-8: Vinylidene chloride/acrylic acid/methyl acrylate/glycidyl methacrylate (90:0.3:6.7:3)

V-9: Vinylidene chloride/methacrylic acid/methyl methacrylate/2-hydroxyethyl methacrylate (90:0.5:5.5:4)

V-10: Vinylidene chloride/methacrylic acid/methyl methacrylate/butyl methacrylate/acrylonitrile (75:5:10:5:5)

V-11: Vinylidene chloride/acrylic acid/methyl acrylate/ethyl acrylate/acrylonitrile (90:0.3:3:3:3.7)

V-12: Vinylidene chloride/methacrylic acid/methyl acrylate/methyl methacrylate/methacrylonitrile (80:5:5:5:5)

V-13: Vinylidene chloride/methacrylic acid/methyl acrylate/methyl methacrylate/acrylonitrile (90:0.3:4:4:1.7)

V-14: Vinylidene chloride/acrylic acid/methyl acrylate/methyl methacrylate/acrylonitrile (90:0.3:4:4:1.7)

V-15: Vinylidene chloride/methacrylic acid/methyl methacrylate/glycidyl methacrylate/acrylonitrile (90:0.5:3.5:3:3)

V-16: (Core-shell type latex aqueous dispersion; core: 90% by weight; shell: 10% by weight)

Core: Vinylidene chloride/methyl acrylate/methyl methacrylate/acrylonitrile/acrylic acid (93:3:3:0.9:0.1)

Shell: Vinylidene chloride/methyl acrylate/methyl methacrylate/acrylonitrile/acrylic acid (90:3:3:2:2)

In formulae (I) and (II), the alkyl group represented by $R^1$, $R^2$, $R^3$, or $R^4$ includes a methyl group, an ethyl group, and a butyl group, the alkoxy group represented by $R^1$, $R^2$, $R^3$, or $R^4$ includes a methoxy group, an ethoxy group, and a butoxy group, and the alkylthio group represented by $R^1$, $R^2$, $R^3$, or $R^4$ includes a methylthio group, an ethylthio group and a butylthio group. Specific examples of —NR'R" are $-NH_2$, $-NHCH_3$, and $-NHC_2H_5$. Specific examples of —NHCOR'" are $-NHCOCH_3$ and $-NHCOC_6H_5$. M in —OM represented by $R^1$, $R^2$, $R^3$, or $R^4$ includes a sodium atom and a potassium atom.

$R^1$ preferably represents a chlorine atom. $R^2$, $R^3$ and $R^4$ each preferably represents an alkoxy group, —OM, or —NR'R", and more preferably —OM. Where $R^2$, $R^3$ or $R^4$ is an alkoxy group or —NR'R", it may be substituted with a sulfo group or a salt thereof, a carboxyl group or a salt thereof, an alkoxy group, etc.

Examples of the divalent group represented by L in formula (II) are $-CH_2-$, $\leftarrow CH_2 \rightarrow_2$, $\leftarrow CH_2 \rightarrow_3$, $\leftarrow CH_2 \rightarrow_2 O \leftarrow CH_2 \rightarrow_2$,

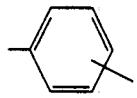

(bonded at any of o-, m-, and p-positions), and

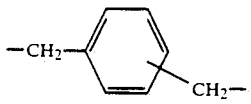

(bonded at any of o-, m-, and p-positions). L, preferably represents an alkylene group $Q^1$ and $Q^2$ each preferably represents —O—or —NH—. l and m each preferably represents 1.

In formulae (I) and (II), the alkyl group, alkoxy group, and alkylthio group represented by $R^1$, $R^2$, $R^3$, or $R^4$, the alkyl group and aryl group represented by R', R", or R'", and the alkylene group and arylene group represented by L preferably have 20 or less carbon atoms.

Details of the compounds of formula (I) including methods of synthesis are described in U.S. Pat. No. 3,645,743, JP-B-47-6151, JP-B-47-33380, JP-B-51-9607, JP-A-48-19220 JP-A-51-78788, JP-A-52-60612, JP-A-52-128130, JP-A-52-130326, and JP-A-56-1043. Details of the compounds of formula (II) including methods of synthesis are described in British Pat. 2061261B, Canadian Pat. 895,808, JP-B-58-33542, and JP-A-57-40244.

Specific examples of the compounds represented by formula (I) or (II) are shown below for illustrative purposes only, and the present inventions should not be construed as being limited to these examples.

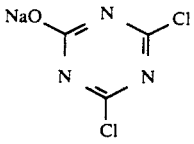

H-1

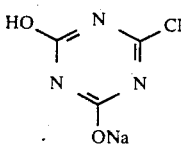

H-2

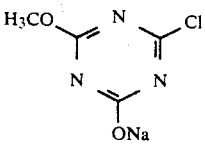

H-3

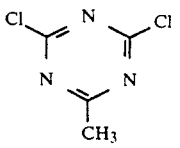

H-4

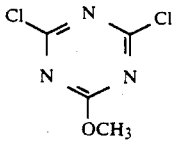

H-5

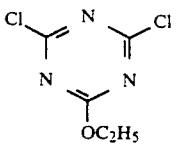

H-6

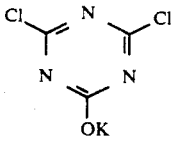

H-7

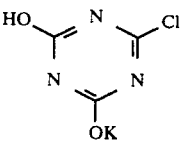

H-8

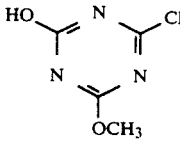

H-9

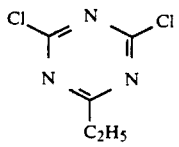

H-10

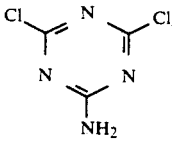

H-11

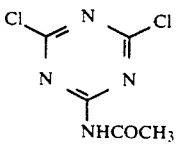

H-12

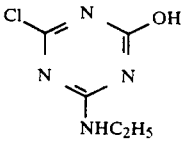

H-13

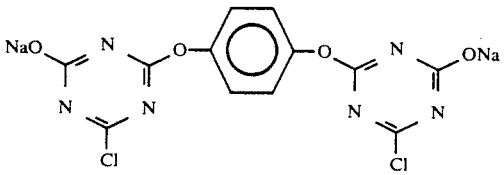

H-14

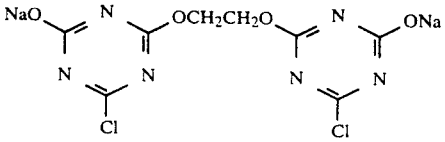

H-15

-continued

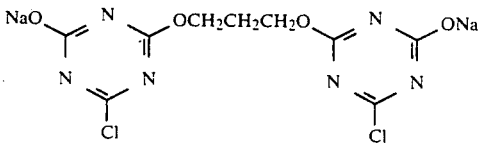

H-16

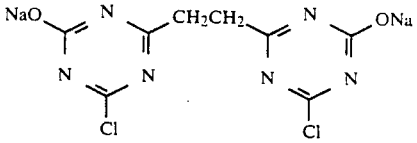

H-18

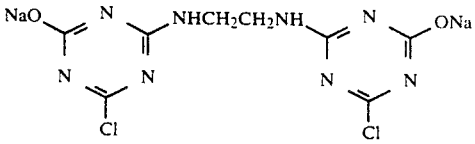

H-19

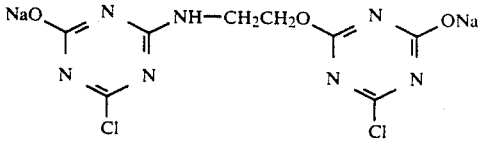

H-20

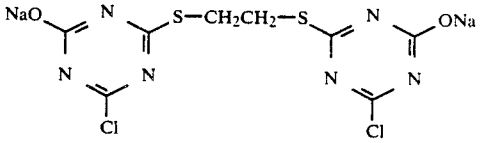

H-21

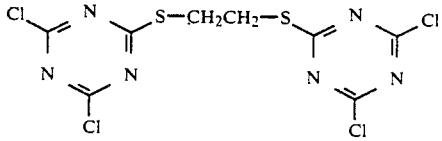

H-22

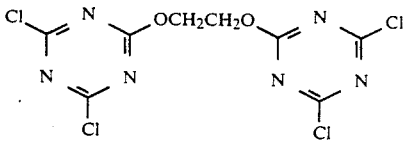

H-23

The compounds of formula (I) or (II) may be used either individually or as a mixture of two or more thereof.

The compounds of formula (I) or (II) are used in an amount of preferably 0.1 to 10%, more preferably 0.3 to 3%, by weight based on the vinylidene chloride copolymer.

It is preferable to add colloidal silica to the subbing layer to markedly improve adhesion between the support and the subbing layer, especially when a silver halide photographic material is allowed to stand in a high humidity atmosphere (e.g., 25° C. and 85% RH) for a long time (e.g., 3 days).

Colloidal silica which can be used in the present invention has an average particle size of from 7 to 120 mμ. It mainly comprises silicon dioxide and may contain, as a small amount component (1–3 wt %), alumina or sodium aluminate. Further, the colloidal silica may contain, as stabilizers, inorganic bases (e.g., sodium hydroxide, potassium hydroxide, lithium hydroxide, and ammonia) or organic bases (e.g., a tetramethylammonium ion). Details for the above-described colloidal silica are described; e.g., in Egon Matijevic (ed.), *Surface and Colloid Science,* Vol. 6, pp. 3–100, John Wiley & Sons (1973).

Specific examples of suitable colloidal silica include those sold by E. I. Du Pont de Nemours & Co. (U.S.A.) under trademarks of Ludox AM, Ludox AS, Ludox LS, Ludox TM, and Ludox HS; by Nissan Chemicals Industries, Ltd. (Tokyo, Japan) under trademarks of Snowtex 20, Snowtex C, Snowtex N, Snowtex O, Snowtex S, Snowtex SS, Snowtex XS, Snowtex ZL, and Snowtex YL; by Monsanto Co. (U.S.A.) under trademarks of Syton C-30 and Syton 200; and by Nalco Chem. Co. (U.S.A.) under trademarks of Nalcoag 1030, Nalcoag 1060, and Nalcoag ID-21-64.

The colloidal silica is preferably used in an amount of from 0.1 to 10% by weight, and more preferably from 1 to 5% by weight, on a dry basis based on the vinylidene chloride copolymer.

The subbing layer according to the present invention preferably has a thickness of from 0.3 to 5 μm, and more preferably from 0.4 to 1.5 μm.

If desired, the subbing layer may contain, in addition to the vinylidene chloride copolymer and the compound of formula (I) or (II), various additives, such as matting agents, surface active agents, acids or alkalis for pH adjustment, dyes, etc.

The means for forming the subbing layer is not particularly limited, but it is desirable that an aqueous coating composition containing the aqueous dispersion of the vinylidene chloride copolymer and the compound of formula (I) or (II) is coated on a polyester support in a known manner, followed by drying.

The manner of coating the aqueous coating composition on a polyester support is conventional and includes air knife coating, bar coating, roll coating, and the like.

If desired, the aqueous coating composition may be cooled on coating to 5° to 15° C.

The drying of the aqueous coating composition is preferably carried out at a temperature between 80° C. and 190° C. for a period of from 20 seconds to 5 minutes.

The polyester which can be used in the support mainly comprises an aromatic dibasic acid component and a glycol component. Typical examples of the dibasic acid include terephthalic acid, isophthalic acid, p-β-hydroxyethoxybenzoic acid, diphenylsulfonedicarboxylic acid diphenoxyethanedicarboxylic acid, adipic acid, sebacic acid azelaic acid 5-sodium sulfoisophthalic acid, diphenylenedicarboxylic acid, and 2,6-naphthalenedicarboxylic acid. Typical examples of the glycol include ethylene glycol, propylene glycol, butanediol, neopentylene glycol, 1,4-cyclohexanediol, 1,4-cyclohexanedimethanol, 1,4-bisoxyethoxybenzene, bisphenol A, diethylene glycol, and polyethylene glycol.

Of the polyesters comprising these components, polyethylene terephthalate is the most advantageous from the standpoint of availability.

The thickness of the polyester support is not particularly limited but, from the standpoint of ease on handling and general-purpose properties, it is from about 12 to 500 μm, and preferably from about 40 to 200 μm. A biaxially stretched and thereby crystallized polyester support is particularly advantageous from the viewpoint of stability and strength.

Prior to coating a first subbing layer, the surface of the polyester support may be subjected to a pre-treatment, such as a corona discharge.

According to the present invention, complicated pre&treatments, such as a glow discharge treatment which should be done in a vacuum and a treatment with a chromic acid mixture which is greatly restricted for prevention of environmental pollution, are not required.

The hydrophilic colloidal layer of the photographic light-sensitive material according to the present invention includes a silver halide emulsion layer, a backing layer a protective layer, an intermediate layer, etc. A hydrophilic colloid is used in these layers Gelatin is the most preferred hydrophilic colloid. The gelatin to be used includes any of those commonly employed in the art, such as so-called lime-processed gelatin, acid-processed gelatin, enzyme-processed gelatin and, in addition, gelatin derivatives and denatured gelatin. Preferred among these are lime-processed gelatin and acid-processed gelatin.

Other usable hydrophilic colloids include proteins (e.g., colloidal albumin and casein); cellulose compounds (e.g., carboxymethyl cellulose and hydroxyethyl cellulose); sugar derivatives (e.g., agar, sodium alginate, and starch derivatives); and synthetic hydrophilic colloids (e.g. polyvinyl alcohol, poly-N-vinylpyrrolidone, polyacrylic acid copolymers, polyacrylamide, and derivatives or partial hydrolysis products thereof). If desired, a mixture of two or more of these hydrophilic colloids may be used.

The polymer latex which can be used in the present invention is an aqueous dispersion of a water-insoluble polymer having an average particle size of from 20 to 200 mμ. The polymer latex is preferably used at a dry weight ratio of from 0.01 to 1.0, and more preferably from 0.1 to 0.8, based on gelatin used as a binder.

Examples of suitable polymer latices which can be used in the present invention are those having an alkyl ester, a hydroxyalkyl ester or a glycidyl ester of acrylic acid or an alkyl ester, a hydroxylalkyl ester or a glycidyl ester of methacrylic acid as a monomer unit and having a weight-average molecular weight of 100,000 or more, and preferably from 300,000 to 500,000. Specific examples of these polymers are shown below.

$$\left(CH_2-\underset{\underset{COOC_4H_9}{|}}{CH}\right)_n$$ Polymer-1

$$\left(CH_2-\underset{\underset{COOC_3H_7}{|}}{CH}\right)_n$$ Polymer-2

$$\left(CH_2-\underset{\underset{COOC_2H_5}{|}}{CH}\right)_n$$ Polymer-3

$$\left(CH_2-\overset{\overset{CH_3}{|}}{\underset{\underset{COOC_4H_9}{|}}{C}}\right)_n$$ Polymer-4

-continued

Polymer-5

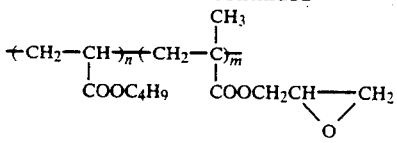

(m:n = 5:95)

Polymer-6

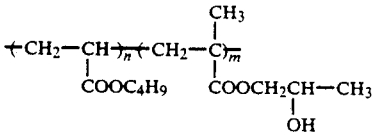

(m:n = 5:95)

For the details of the polymer latices, one can refer to JP-B-45-5331 and U.S. Pat. Nos. 2,852,386, 3,062,674, 3,411,911, and 3,411,912.

The polymer latex is incorporated into at least one hydrophilic colloidal layer, such as a silver halide emulsion layer, a backing layer, a protective layer, and an intermediate layer.

The effects of the present invention are particularly manifested in a superhigh contrast light-sensitive material containing a hydrazine derivative.

With respect to the hydrazine derivative-containing superhigh contrast light-sensitive materials and image formation systems using the same, one can refer to U.S. Pat. Nos. 4,224,401, 4,168,977, 4,166,742, 4,241,164, and 4,272,606, JP-A-60-83028, JP-A-60218642, JP-A-60-258537, and JP-A-61-223738.

The effects of the present invention are also pronounced in systems used in obtaining a high contrast, in which a light-sensitive material containing a tetrazolium compound is treated with a PQ type or MQ type developer containing a sulfite in a relatively high concentration. Details of the image formation system using a tetrazolium compound are described in JP-A-52-18317, JP-A-53-17719, and JP-A-53-17720.

Silver halide emulsions which can be used in the photographic material of the present invention can generally be prepared by mixing a solution of a water-soluble silver salt (e.g., silver nitrate) and a solution of a water-soluble halogen salt (e.g., potassium bromide) in the presence of a solution of a water-soluble high polymer (e.g., gelatin).

The silver halide may be any of silver chloride, silver bromide, silver chlorobromide, silver iodobromide, and silver ohloroiodobromide. The silver halide is not particularly limited in grain shape and size distribution.

The silver halide emulsion layer can contain a light-sensitive silver halide, a chemical sensitizer, a spectral sensitizer, an antifoggant, a hydrophilic colloid (particularly gelatin), a gelatin hardening agent, a film property-improving agent such as a surface active agent, a thickener, and the like. For details regarding these additives, one can refer to *Research Disclosure,* Vol. 176, Item 17643 (Dec., 1978), JP-A-52-108130, JP-A-52-114328, JP-A-52-121321, JP-A-53-3217, and JP-A-53-44025.

Examples of surface active agents which are particularly preferred in the present invention are polyalkylene oxides having a molecular weight of 600 or more as described in JP-B-58-9412.

The surface protective layer is a layer containing a hydrophilic colloid (e.g., gelatin) as a binder and has a thickness of from 0.3 to 3 μm, and preferably from 0.5 to 1 5 μm. The protective layer contains a matting agent (e.g., fine particles of polymethyl methacrylate), colloidal silica and, if desired, a thickener (e.g., potassium polystyrenesulfonate), a gelatin hardening agent, a surface active agent, a slipping agent, an ultraviolet absorbent, etc.

The backing layer is a light-insensitive layer containing a hydrophilic colloid (e.g., gelatin) as a binder. It is composed of a single layer or multiple layers containing an intermediate layer, a protective layer, etc. The backing layer has a thickness of from 0.1 to 10 μm. If desired, the backing layer may contain a gelatin hardening agent, a surface active agent, a matting agent, colloidal silica, a slipping agent, an ultraviolet absorbent, a dye, a thickener, etc. similarly to the silver halide emulsion layer and surface protective layer.

The technique of the present invention is applicable to various photographic materials having a hydrophilic colloid layer, and typically photographic materials using silver halide as a light-sensitive component, such as light-sensitive materials for printing, X-ray films, general negative films, general reversal films, general positive films and direct positive films. The effects of the present invention are particularly remarkable in light-sensitive materials for printing.

Methods of exposure to light and methods of development processing which can be used for the light-sensitive materials of the present invention are not particularly restricted. For example, one can refer to JP-A52-108130, JP-A-52-114328, JP-A-52-111321, and *Research Disclosure,supra.*

In the present invention, the reduction of development time by increasing the rate of development can be realized by the addition of an amine to the developer, as suggested in JP-A-60-258537 and U.S. Pat. No. 4,269,929.

The present invention is now illustrated in greater detail by way of the following Examples, but it should be understood that the present invention is not deemed to be limited thereto. All the percents, parts, and ratios are by weight unless otherwise specified.

EXAMPLE 1

A first subbing layer and a second subbing layer having the following formulations were successively coated in that order on both sides of a 100 μm thick biaxially-stretched polyethylene terephthalate film support. The resulting coated supports were designated Samples 101 to 115.

(1) First Subbing Layer Formulation

| | |
|---|---|
| Vinylidene chloride latex (shown in Table 1) | 15 parts |
| Compound H-1 | see Table 1 |
| Polystyrene fine particles (average particle size: 3 m) | 80 mg/m$^2$ |
| Distilled water to make | 100 parts |
| 10% KOH aqueous solution to adjust to a pH of 6 | |

| Coating Conditions: | |
|---|---|
| Coating composition temperature: | 10° C. |
| Dry film thickness: | shown in Table 1 |
| Drying conditions: | 180° C. × 2 mins. |

(2) Second Subbing Layer Formulation

| | |
|---|---|
| Gelatin | 1 part |
| Methyl cellulose | 0.05 part |
| $HO\text{-}(C(=O))_4\text{-}C(=O)\text{-}NH(CH_2)_2\text{-}N(CH_2CHOHCH_2Cl)\text{-}(CH_2)_2NH\text{-}_4HCl$ | 0.02 part |
| $C_{12}H_{25}O(CH_2CH_2O)_{10}H$ | 0.03 part |
| 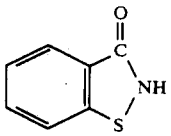 | $3.5 \times 10^{31}$ part |
| Acetic acid | 0.2 part |
| Water | to make 100 parts |
| Coating Conditions: | |
| Coating composition temperature: 25° C. | |
| Dry thickness of coating: 0.1 μm | |
| Drying conditions: 170° C. × 2 mins. | |

Coated supports (Samples 116 to 119) were prepared in the same manner as described above, except for replacing Compound H-1 in the first subbing layer with the following compounds.

| Sample No. | Compound Added | Amount Added (part) |
|---|---|---|
| 116 | Sumitex Resin M-3 (produced by Sumitomo Chemical Co., Ltd.) | 1 |
| 117 | Denacol EX 310 (produced by Nagase Kasei K.K.) | 1 |
| 118 | 1,6-Hexamethylenediethyleneurea | 1 |
| 119 | $Mg(OH)_2$ | 1 |

A first silver halide emulsion layer, a second silver halide emulsion layer, a first protective layer and a second protective layer were coated and dried in that order on one side of each of the resulting coated supports. A backing layer and a third protective layer in that order were coated and dried on the opposite side of the support. The formulations of these layers are described below.

(1) First Silver Halide Emulsion Layer Formulation

| | |
|---|---|
| Solution I: | 300 ml of water and 9 g of gelatin |
| Solution II: | 100 g of $AgNO_3$ and 400 ml of water |
| Solution IIIA: | 37 g of NaCl, 1.1 mg of $(NH_4)_3RhCl_6$, and 400 ml of water |

Solution I was kept at 45° C., and Solutions II and IIIA were simultaneously added at a constant rate to Solution I. After removing soluble salts in a flocculation method, gelatin was added to the emulsion, and 6-methyl-4-hydroxy-1,3,3a,7-tetraazaindene was further added thereto as a stabilizer. The resulting emulsion was designated Emulsion A. Emulsion A was a mono-dispersion having a mean grain size of 0.20 μm and containing 60 g of gelatin per kg.

Compound (a): $5 \times 10^{-3}$ mol/mol of Ag

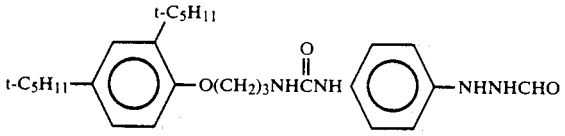

Compound (b): 120 mg/m²

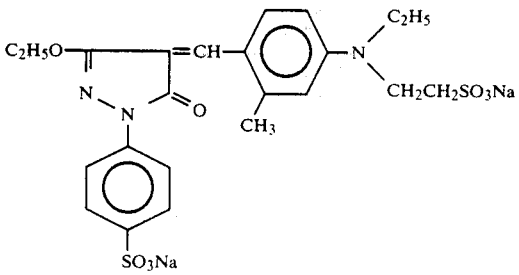

Compound (c):

-continued

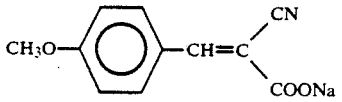

20 mg/m²

Compound (d):

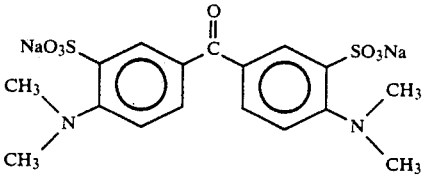

20 mg/m²

Compound (e):

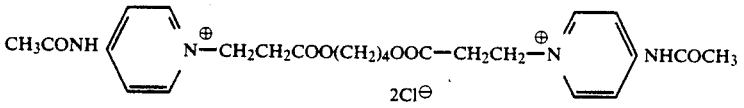

9 mg/m²

| | |
|---|---|
| Sodium polystyrenesulfonate | 30 mg/m² |
| Sodium N-oleoyl-N-methyltaurine | 50 mg/m² |
| 1,2-Bis(vinylsulfonylacetamido)ethane | 70 mg/m² |
| 1-Phenyl-5-mercaptotetrazole | 3 mg/m² |
| Ethyl acrylate latex (average particle size: 0.1 μm) | 40 mg/m² |

The resulting coating composition for the first silver halide emulsion layer was coated to a silver coverage of 2 g/m².

(2) Second Silver Halide Emulsion Layer

| | |
|---|---|
| Solution I: | 300 ml of water and 9 g of gelatin |
| Solution II: | 100 g of $AgNO_3$ and 400 ml of water |
| Solution IIIB: | 37 g of NaCl, 2.2 mg of $(NH_4)_3RhCl_6$, and 400 ml of water |

Emulsion B was prepared in the same manner as Emulsion A, except for using Solution IIIB in place of Solution IIIA. Emulsion B was mono-dispersion having a mean grain size of 0.20 μm.

Compounds (a) to (e) as used in the first silver halide emulsion layer and other compounds as follows were added to Emulsion B.

| | |
|---|---|
| Compound (a) | $5 \times 10^{-3}$ mol/mol of Ag |
| Compound (b) | 120 mg/m² |
| Compound (c) | 100 mg/m² |
| Compound (d) | 100 mg/m² |
| Compound (e) | 9 mg/m² |
| Sodium polystyrenesulfonate | 50 mg/m² |
| Sodium N-oleoyl-N-methyltaurine | 40 mg/m² |
| 1,2-Bis(vinylsulfonylacetamido)ethane | 85 mg/m² |
| 1-Phenyl-5-mercaptotetrazole | 3 mg/m² |
| Ethyl acrylate latex (average particle size: 0.1 μm) | 40 mg/m² |

The resulting coating composition for the second silver halide emulsion layer was coated to a silver coverage of 2 g/m².

(3) First Protective Layer Formulation

| | |
|---|---|
| Gelatin | 1.0 g/m² |
| Lipoic acid | 5 mg/m² |
| Sodium dodecylbenzenesulfonate | 5 mg/m² |
| Compound (c) | 20 mg/m² |
| Sodium salt of sulfuric ester of polyoxyethylene nonylphenyl ether (degree of polymerization: 5) | 5 mg/m² |
| Sodium polystyrenesulfonate | 10 mg/m² |
| Compound (d) | 20 mg/m² |
| Ethyl acrylate latex (average particle size: 0.1 μm) | 200 mg/m² |

(4) Second Protective Layer Formulation

| | |
|---|---|
| Gelatin | 1.0 g/m² |
| Polymethyl methacrylate fine particles (average particle size: 3 μm) | 60 mg/m² |
| Sodium dodecylbenzenesulfonate | 20 mg/m² |
| N-Perfluorooctanesulfonyl-N-propylglycine potassium salt | 3 mg/m² |
| Sodium salt of sulfuric ester of polyoxyethylene nonylphenyl ether (degree of polymerization: 5) | 15 mg/m² |
| Sodium polystyrenesulfonate | 2 mg/m² |

(5) Backing Layer Formulation

| | |
|---|---|
| Gelatin | 2.5 g/m² |

-continued

| | |
|---|---|
| 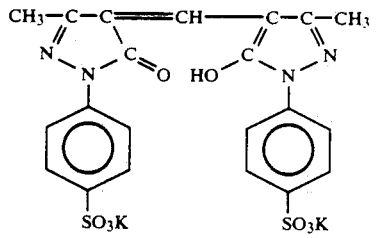 | 300 mg/m² |
| 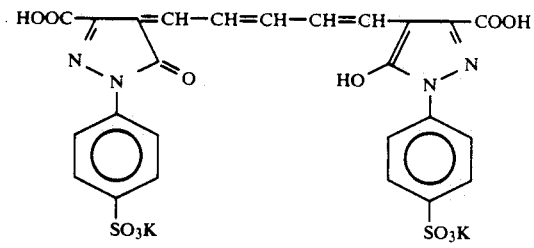 | 50 mg/m² |
| 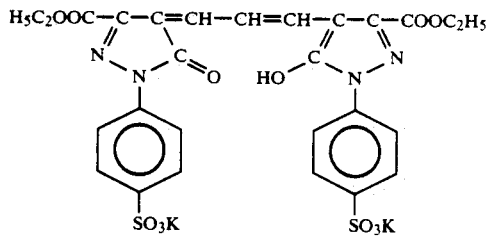 | 50 mg/m² |
| Sodium dodecylbenzenesulfonate | 50 mg/m² |
| Sodium dihexyl-α-sulfosuccinate | 20 mg/m² |
| Sodium polystyrenesulfonate | 40 mg/m² |
| 1,3-Divinylsulfonyl-2-propanol | 150 mg/m² |
| Ethyl acrylate latex (average particle size: 0.1 μm) | 500 mg/m² |

(6) Third Protective Layer Formulation

| | |
|---|---|
| Gelatin | 1 g/m² |
| Polymethyl methacrylate fine particles (average particle size: 3 μm) | 40 mg/m² |
| Sodium dodecylbenzenesulfonate | 15 mg/m² |
| Sodium dihexyl-α-sulfosuccinate | 10 mg/m² |
| Sodium polystyrenesulfonate | 20 mg/m² |
| Sodium acetate | 40 mg/m² |

The thus prepared samples 101 to 119 were stored at 25° C. and 60% RH (relative humidity) for 2 weeks.

The dimensional change with processing, adhesion while dry (dry adhesion), and adhesion while wet (wet adhesion) properties of the stored samples were evaluated according to the following test methods.

(1) Dimensional Change With Processing

Two 8 mm diameter holes were made in the sample at a 200 mm distance from each other. After the sample was allowed to stand in a room at 25° C. and 30% RH, the distance between the two holes (X mm) was precisely measured with a pin gauge having a precision of 1/1000 mm. Then, the sample was subjected to development, fixing, rinsing, and drying by means of an automatic developing machine and, after 5 minutes, the distance between the two holes (Y mm) was measured. The rate of dimensional change (%) with processing was calculated from equation: $(Y-X)/200\times 100$.

It is accepted in the art that a rate of dimensional change within ±0.01% gives rise to no problem for practical use.

In this testing, the development processing was carried out using an automatic developing machine "FG-660", a developer "GRD-1" and a fixer "GRF-1", all produced by Fuji Photo Film Co., Ltd., at 38° C. for 20 seconds. The drying temperature was 45° C.

(2) Dry Adhesion

The surface of the sample was hatched with a razor to reach the support surface by 7 parallel lines at 5 mm intervals both in the longitudinal and transverse directions to make 36 squares. An adhesive tape ("Nitto Tape" produced by Nitto Electric Industrial Co., Ltd.) was adhered on the crosshatched sample and rapidly stripped off at a peel angle of 180°. The dry adhesion was evaluated according to the following rating system.

A: At least 95% of the squares were not peeled off.

B: At least 90% and less than 95% of the squares were not peeled off.

C: At least 60% and less than 90% of the squares were not peeled off.

D: Less than 60% of the squares were not peeled off.

Samples rated "A" had an adhesion strength sufficient to withstand practical use as a photographic material.

(3) Wet Adhesion

A cross was scratched on the emulsion surface of the film with a stylus in each course of development, fixing, and rinsing, and after the development processing, the cross was strongly rubbed 5 times with a fingertip. The maximum width of the emulsion layer which was peeled off along the cross mark by the rubbing was measured to evaluate the adhesion strength of the emulsion layer according to the following rating system.

A: The emulsion layer was not peeled off.

B: The maximum peeled width was not more than 2 mm.

C: The maximum peeled width was not more than 5 mm.

D: The maximum peeled width exceeds 5 mm.

Samples rated "A" had an adhesion strength sufficient for practical use as a photographic material.

In the above testing, the development processing was carried out under the following conditions.

Development: GRD-1 (made by Fuji Photo Film Co., Ltd.) 38° C.×20 sec.

Fixing: GRF-1 (made by Fuji Photo Film Co., Ltd.) 38° C.×20 sec.

Rinsing: 25° C.×20 sec. The results of these evaluations are shown in Table 1 below.

TABLE 1

| Sample No. | Vinylidene Latex | Thickness of First Subbing Layer (μm) | Amount of H-1 (%*) | Dry Adhesion | Wet Adhesion | Rate of Dimensional Change With Processing (%) | Remark |
|---|---|---|---|---|---|---|---|
| 101 | V-14 | 0.9 | 0 | D | C | 0.006 | Comparison |
| 102 | " | " | 1 | A | A | 0.007 | Invention |
| 103 | " | " | 2 | A | A | 0.007 | " |
| 104 | " | " | 3 | A | A | 0.006 | " |
| 105 | " | 0.1 | 2 | C | A | 0.017 | Comparison |
| 106 | " | 0.2 | " | C | A | 0.014 | " |
| 107 | " | 0.3 | " | A | A | 0.009 | Invention |
| 108 | " | 0.6 | " | A | A | 0.008 | " |
| 109 | " | 0.9 | " | A | A | 0.006 | " |
| 110 | " | 1.2 | " | A | A | 0.005 | " |
| 111 | " | 1.5 | " | A | A | 0.005 | " |
| 112 | V-16 | 0.9 | " | A | A | 0.005 | " |
| 113 | V-100** | " | 0 | D | D | 0.006 | Comparison |
| 114 | " | " | 2 | B | C | 0.007 | " |
| 115 | V-101*** | 0.9 | 2 | A | A | 0.015 | Comparison |
| 116 | V-14 | " | 0 | B | C | 0.013 | " |
| 117 | " | " | " | C | B | 0.012 | " |
| 118 | " | " | " | B | C | 0.010 | " |
| 119 | " | " | " | B | C | 0.007 | " |

Note:
*Based on vinylidend chloride latyex.
**Vinylidene chloride/mehtyl acrylate/methyl methacrylate/acrylonitrile = 90:4:4:2
***Vinylidene chloride/acrylic acid/methyl acrylate/methyl methacrylate/acrylonitrile = 65:5:10:10:10

The results in Table 1 clearly demonstrate the superior effects of the present invention.

EXAMPLE 2

A first subbing layer having the following formulation was coated on both sides of a 100 μm thick biaxially-stretched polyester film support which had been subjected to a corona discharge treatment under the following conditions.

| | |
|---|---|
| Corona Discharge Treatment Conditions: | |
| Width of Support: 30 cm | |
| Running Speed of Support: 30 m/min | |
| Electrode Gap: 1.8 mm | |
| Electric Power: 200 W | |
| First Subbing Layer Formulation: | |
| Vinylidene chloride latex (shown in Table 2) | 15 parts |
| Compound H-1 | see Table 2 |
| Polystyrene fine particles (average particle size: 3 μm) | 80 mg/m$^2$ |

-continued

| | |
|---|---|
| 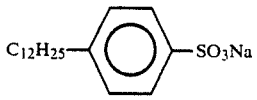 | 0.15 part |
| Distilled water to make | 100 parts |
| 10% KOH solution to adjust to a pH of 6 | |
| Coating Conditions: | |
| Coating composition temperature: 15° C. | |
| Dry film thickness: shown in Table 2 | |
| Drying conditions: 150° C. × 2 mins. | |

The surface of the thus formed first subbing layer was subjected to a corona discharge treatment under the same conditions as described above, and a second subbing layer having the same formulation as used in Example 1 was then coated thereon.

A silver halide emulsion layer and a first protective layer were coated in that order on one side of the coated support, while a backing layer and a second protective layer were coated on the other side in that order to obtain Samples 201 to 215. The formulations of these layers are shown below.

(1) Silver Halide Emulsion Layer Formulation

| | |
|---|---|
| Solution I: | 300 ml of water and 9 g of gelatin |
| Solution II: | 100 g of $AgNO_3$ and 400 ml of water |
| Solution III: | 37 g of NaCl, 0.66 mg of $(NH_4)_3RhCl_6$, and 400 ml of water |

Solution I was kept at 40° C., and Solutions II and III were simultaneously added at a constant rate to Solution I. After removing soluble salts in a flocculation method, gelatin was added to the emulsion, and 6-methyl-4-hydroxy-1,3,3a,7-tetraazaindene and 4-hydroxy-5,6-trimethylene-1,3,3a,7tetraazaindene were further added thereto as stabilizers. The resulting emulsion was a mono-dispersion having a mean grain size of 0.15 μm and containing 60 g of gelatin per kg.

The following compounds were added to the emulsion.

| | |
|---|---|
| 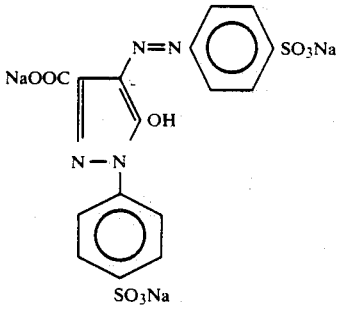 | 5 mg/m² |
| Sodium polystyrenesulfonate | 10 mg/m² |
| 1,2-Bis(vinylsulfonylacetamido)ethane | 100 mg/m² |
| Ethyl acrylate latex (average particle size: 0.1 μm) | 500 mg/m² |
| 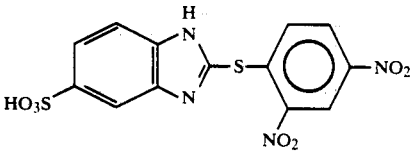 | 0.3 mg/m² |

The thus prepared coating composition was coated to a silver coverage of 3 g/m².

(2) First Protective Layer Formulation

| | |
|---|---|
| Gelatin | 1.5 g/m² |
| 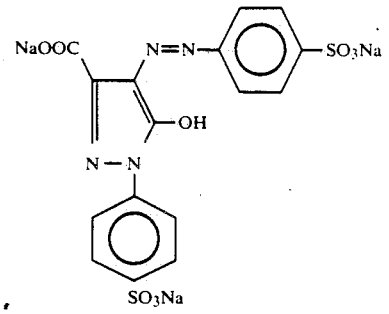 | 5 mg/m² |
| Sodium dodecylbenzenesulfonate | 25 mg/m² |
| Sodium dihexyl-α-sulfosuccinate | 10 mg/m² |
| N-Perfluorooctanesulfonyl-N-propylglycine potassium salt | 2 mg/m² |
| Sodium polystyrenesulfonate | 3 mg/m² |
| Ethyl acrylate latex (average particle size: 0.1 μm) | 200 mg/m² |
| Colloidal silica | 350 mg/m² |
| Lipoic acid | 8 mg/m² |
| Polymethyl methacrylate fine particles (average particle size 3 μm) | 60 mg/m² |

(3) Backing Layer Formulation

| | |
|---|---|
| Gelatin | 2 g/m² |
| 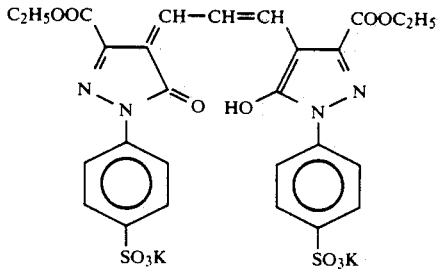 | 30 mg/m² |
| 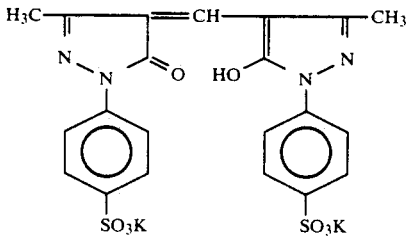 | 180 mg/m² |
| 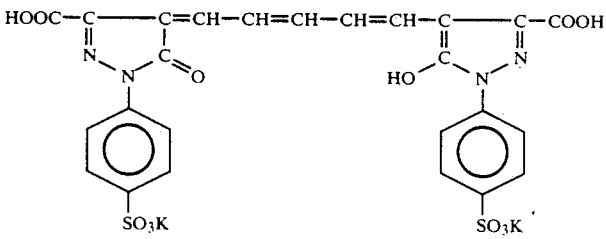 | 50 mg/m² |
| Sodium dihexyl-α-sulfosuccinate | 20 mg/m² |
| Sodium dodecylbenzenesulfonate | 30 mg/m² |
| Sodium polystyrenesulfonate | 30 mg/m² |
| 1,3-Divinylsulfonyl-2-propanol | 100 mg/m² |

-continued

| | |
|---|---|
| Ethyl acrylate latex (average particle size:) 0.1 μm) | 200 mg/m² |

(4) Second Protective Layer Formulation

| | |
|---|---|
| Gelatin | 1 g/m² |
| Polymethyl methacrylate fine particles (the same as used in the first protective layer) | 40 mg/m² |
| Sodium dihexyl-α-sulfosuccinate | 10 mg/m² |
| Sodium dodecylbenzenesulfonate | 30 mg/m² |
| Sodium polystyrenesulfonate | 25 mg/m² |
| Sodium acetate | 30 mg/m² |

The resulting samples were stored at 25° C. and 60% RH for 2 weeks and then evaluated in the same manner as in Example 1. The results obtained are shown in Table 2 below. In Table 2, the asterisks have the same meanings as in Table 1.

TABLE 2

| Sample No. | Vinylidene Latex | Thickness of First Subbing Layer (μm) | Amount of H-1 (%*) | Dry Adhesion | Wet Adhesion | Rate of Dimensional Change With Processing (%) | Remark |
|---|---|---|---|---|---|---|---|
| 201 | V-14 | 0.9 | 0 | D | C | 0.006 | Comparison |
| 202 | " | " | 1 | A | A | 0.006 | Invention |
| 203 | " | " | 2 | A | A | 0.006 | " |
| 204 | " | " | 3 | A | A | 0.007 | " |
| 205 | " | 0.1 | 2 | C | A | 0.018 | Comparison |
| 206 | " | 0.2 | 2 | C | A | 0.014 | " |
| 207 | " | 0.3 | 2 | A | A | 0.010 | Invention |
| 208 | " | 0.6 | 2 | A | A | 0.009 | " |
| 209 | " | 0.9 | 2 | A | A | 0.008 | " |
| 210 | " | 1.2 | 2 | A | A | 0.005 | " |
| 211 | " | 1.5 | 2 | A | A | 0.004 | " |
| 212 | V-16 | 0.9 | 2 | A | A | 0.006 | " |
| 213 | V-100** | 0.9 | 0 | D | D | 0.007 | Comparison |
| 214 | " | 0.9 | 2 | B | C | 0.007 | " |
| 215 | V-101*** | 0.9 | 2 | A | A | 0.016 | " |

The results in Table 2 clearly demonstrate the superior effects of the present invention.

EXAMPLE 3

A silver halide emulsion layer, a first protective layer, and a second protective layer were coated in that order on one side of each of the coated supports of Examples 1 (Samples 101 to 115), while a backing layer and a third protective layer were coated on the other side in that order. The formulations of these layers are shown below. The resulting samples were designated Samples 301 to 315.

(1) Silver Halide Emulsion Formulation

An aqueous gelatin solution was kept at 35° C., and a silver nitrate aqueous solution and a sodium chloride aqueous solution containing $1.3\times10^{-4}$ mol of ammonium hexachlororhodate (III) per mol of silver were simultaneously added to the gelatin solution over a period of 10 minutes while controlling the potential at 200 mV to prepare mono-dispersed silver chloride cubic grains having a mean grain size of 0.08 μm. After the grain formation, soluble salts were removed by a flocculation method well-known in the art, and 4-hydroxy-6-methyl-1,3,3a,7-tetraazaindene and 1-phenyl-5-mercaptotetrazole were added thereto as stabilizers.

Then, $1\times10^{-3}$ mol/mol of Ag of Compound Q-1 as shown below and $1\times10^{-4}$ mol/mol of Ag of Compound Q-2 as shown below were added to the emulsion. To the emulsion were further added polyethyl acrylate in an amount of 50% (on a solid basis) based on the gelatin in the emulsion, 35 mg/m² of a compound having the formula:

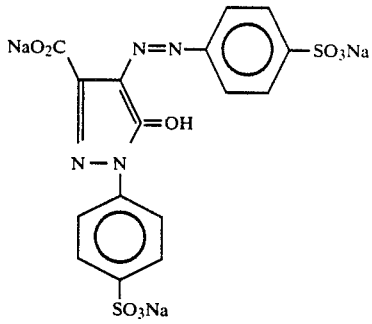

and 145 mg/m² of 2-bis(vinylsulfonylacetamido)ethane as a hardening agent.

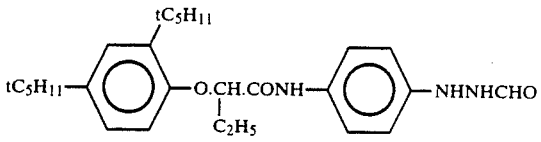

Q-1

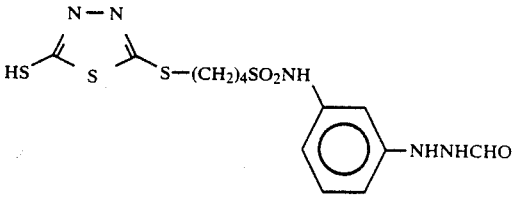

Q-2

(2) First Protective Layer Formulation

| | |
|---|---|
| Gelatin | 1 g/m² |
| Thioctic acid | 6 mg/m² |

-continued

| | |
|---|---|
| 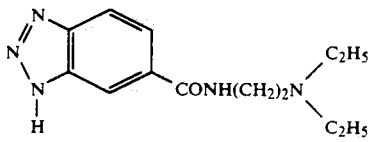 | 90 mg/m² |
| 1,5-Dihydroxy-2-benzaldoxime | 35 mg/m² |
| Sodium dodecylbenzenesulfonate | 10 mg/m² |
| Sodium polystyrenesulfonate | 20 mg/m² |
| Ethyl acrylate latex (average particle size: 0.05 μm) | 0.2 g/m² |

(2) Second Protective Layer Formulation

| | |
|---|---|
| Gelatin | 0.6 g/m² |
| Compound R: 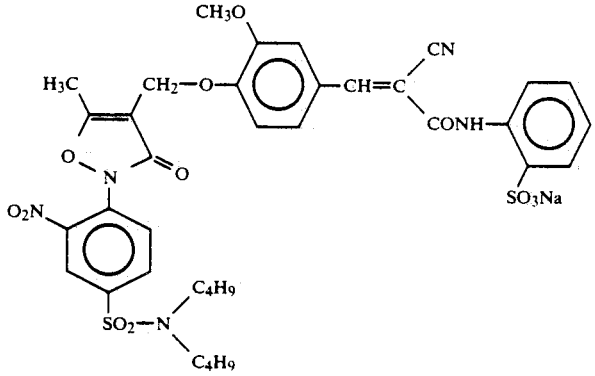 | 0.1 g/m² |
| Polymethyl methacrylate fine particles (average particle size: 2.5 μm) | 20 mg/m² |
| Silicon dioxide fine particles (average particle size: 2.8 μm) | 30 mg/m² |
| N-Perfluorooctanesulfonyl-N-propylglycine potassium salt | 3 mg/m² |
| Sodium dodecylbenzenesulfonate | 20 mg/m² |
| Hydroquinone | 150 mg/m² |

Compound R was incorporated into the emulsion in the form of a gelatin dispersion prepared as follows.

A solution of 18.9 g of Compound R in 25 ml of N,N-dimethylsulfonamide was mixed with 536 g of a 6.5% aqueous gelatin solution containing 13 g of Compound S shown below at 45° C. while stirring to prepare a dispersion.

Compound S $$C_{11}H_{23}CONH(CH_2)_3N^{\oplus}(CH_3)_2(CH_2)_4SO_3^{\ominus}$$

(4) Backing Layer Formulation

| | |
|---|---|
| Gelatin | 2.5 g/m² |
| 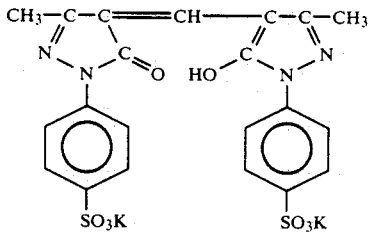 | 0.26 g/m² |
| 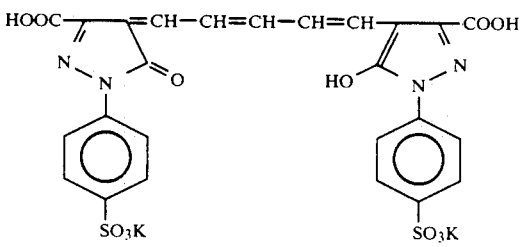 | 30 mg/m² |

-continued

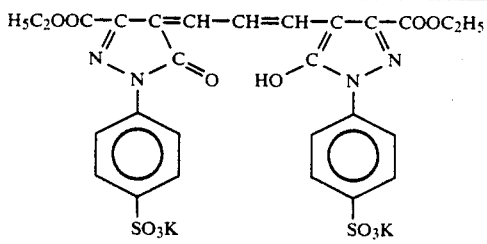

40 mg/m²

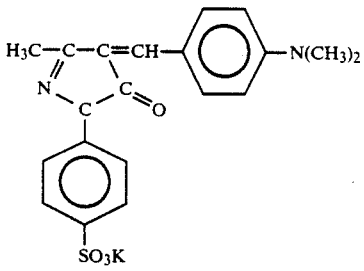

90 mg/m²

| | |
|---|---|
| Sodium dihexyl-α-sulfosuccinate | 30 mg/m² |
| Sodium dodecylbenzenesulfonate | 35 mg/m² |
| 1,3-Divinylsulfonyl-2-propanol | 130 mg/m² |
| Ethyl acrylate latex (average particle size: 0.05 μm) | 0.5 g/m² |

(5) Third Protective Layer Formulation

| | |
|---|---|
| Gelatin | 0.8 g/m² |
| Polymethyl methacrylate fine particles (average particle size: 3.4 μm) | 40 mg/m² |
| Sodium dihexyl-α-sulfosuccinate | 9 mg/m² |
| Sodium dodecylbenzenesulfonate | 10 mg/m² |
| Sodium acetate | 40 mg/m² |

Samples 301 to 315 were stored at 25° C. and 60% RH for 2 weeks and evaluated in the same manner as in Example 1. The results obtained are shown in Table 3 below. In Table 3, the asterisks have the same meaning as in Table 1.

TABLE 3

| Sample No. | Vinylidene Latex | Thickness of First Subbing Layer (μm) | Amount of H-1 (%*) | Dry Adhesion | Wet Adhesion | Rate of Dimensional Change With Processing (%) | Remark |
|---|---|---|---|---|---|---|---|
| 301 | V-14 | 0.9 | 0 | D | C | 0.007 | Comparison |
| 302 | " | " | 1 | A | A | 0.006 | Invention |
| 303 | " | " | 2 | A | A | 0.007 | " |
| 304 | " | " | 3 | A | A | 0.006 | " |
| 305 | " | 0.1 | 2 | C | A | 0.016 | Comparison |
| 306 | " | 0.2 | 2 | C | A | 0.013 | " |
| 307 | " | 0.3 | 2 | A | A | 0.010 | Invention |
| 308 | " | 0.6 | 2 | A | A | 0.009 | " |
| 309 | " | 0.9 | 2 | A | A | 0.007 | " |
| 310 | " | 1.2 | 2 | A | A | 0.006 | " |
| 311 | " | 1.5 | 2 | A | A | 0.004 | " |
| 312 | V-16 | 0.9 | 2 | A | A | 0.006 | " |
| 313 | V-100** | 0.9 | 0 | D | D | 0.005 | Comparison |
| 314 | " | 0.9 | 2 | C | C | 0.006 | " |
| 315 | V-101*** | 0.9 | 2 | A | A | 0.015 | " |

The results in Table 3 clearly prove the superior effects of the present invention.

EXAMPLE 4

A silver halide emulsion layer and a first protective layer were coated in that order on one side of each of the coated supports of Example 2 (Samples 201 to 215), while a backing layer and a second protective layer were coated on the other side in that order. The formulations of these layers are shown below. The resulting samples were designated Samples 401 to 415.

(1) Silver Halide Emulsion Layer Formulation

An aqueous gelatin solution was kept at 50° C., and a silver nitrate aqueous solution and a mixed aqueous solution of sodium chloride and potassium bromide were simultaneously added to the gelatin solution in the presence of $2\times10^{-5}$ mol/mol of Ag of rhodium chloride at a constant rate over a period of 30 minutes to prepare a mono-dispersed silver chloride emulsion having a mean grain size of 0.2 μm (Cl content: 95 mol %).

After desalting by flocculation, 1 mg of thiourea dioxide and 0.6 mg of chloroauric acid each per mol of Ag were added to conduct ripening at 65° C. to form a fog so that the highest performance could be obtained.

The following compounds were further added to the emulsion.

| | |
|---|---|
| 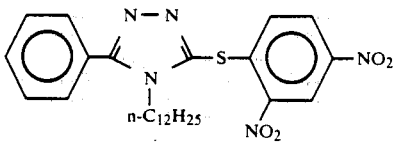 | $2 \times 10^{-2}$ mol/mol of Ag |
| 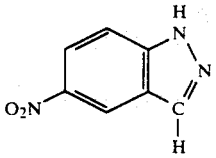 | $1 \times 10^{-3}$ mol/mol of Ag |
| 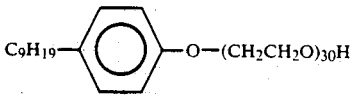 | $4 \times 10^{-4}$ mol/mol of Ag |
| KBr | 20 mg/m$^2$ |
| Sodium polystyrenesulfonate | 40 mg/m$^2$ |
| 2,6-Dichloro-6-hydroxy-1,3,5-triazine sodium salt | 30 mg/m$^2$ |

The thus prepared coating composition was coated to a silver coverage of 3.5 g/m$^2$.

(2) First Protective Layer Formulation

| | |
|---|---|
| Gelatin | 1.5 g/m$^2$ |
| $SiO_2$ fine particles (average particle size: 4 μm) | 50 mg/m$^2$ |
| Sodium dodecylbenzenesulfonate | 50 mg/m$^2$ |
| 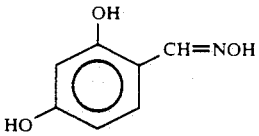 | 20 mg/m$^2$ |
| 5-Nitroindazole | 15 mg/m$^2$ |
| 1,3-Divinylsulfonyl-2-propanol | 50 mg/m$^2$ |
| N-Perfluorooctanesulfonyl-N-propylglycine potassium salt | 2 mg/m$^2$ |
| Ethyl acrylate latex (average particle size: 0.1 μm) | 300 mg/m$^2$ |
| 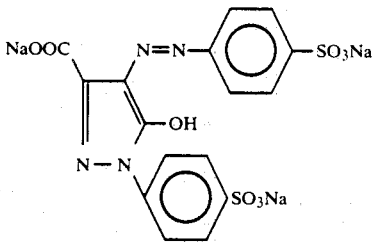 | 100 mg/m$^2$ |

(3) Backing Layer Formulation

| | |
|---|---|
| Gelatin | 2.5 g/m$^2$ |
| 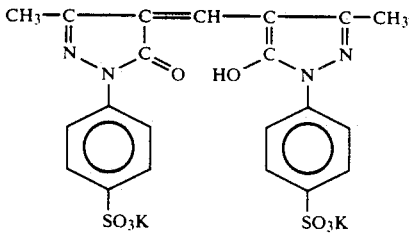 | 30 mg/m$^2$ |
| 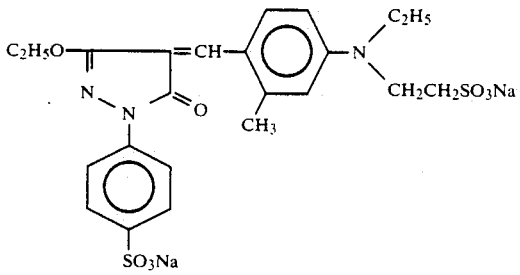 | 140 mg/m$^2$ |
| 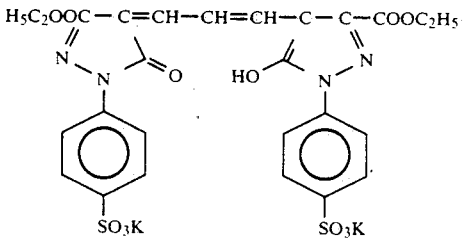 | 40 mg/m$^2$ |

-continued

| | |
|---|---|
| 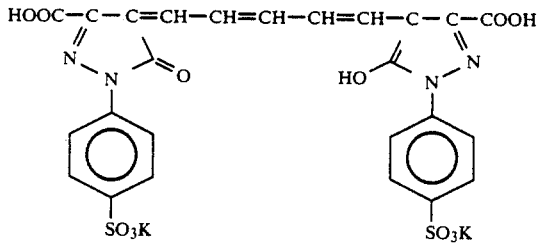 | 80 mg/m² |
| 1,3-Divinylsulfonyl-2-propanol | 150 mg/m² |
| Ethyl acrylate latex (average particle size: 0.1 μm) | 900 mg/m² |
| Sodium dihexyl-α-sulfosuccinate | 35 mg/m² |
| Sodium dodecylbenzenesulfonate | 35 mg/m² |

(4) Second Protective Layer Formulation

| | |
|---|---|
| Gelatin | 0.8 g/m² |
| Polymethyl methacrylate fine particles (average particle size: 3 μm) | 20 mg/m² |
| Sodium dihexyl-α-sulfosuccinate | 10 mg/m² |
| Sodium dodecylbenzenesulfonate | 10 mg/m² |
| Sodium acetate | 40 mg/m² |

The resulting samples were stored at 25° C. and 60% RH for 2 weeks and evaluated in the same manner as in Example 1. The results obtained are shown in Table 4 below. In Table 4, the asterisks have the meaning as in Table 1.

TABLE 4

| Sample No. | Vinylidene Latex | Thickness of First Subbing Layer (μm) | Amount of H-1 (%*) | Dry Adhesion | Wet Adhesion | Rate of Dimensional Change With Processing (%) | Remark |
|---|---|---|---|---|---|---|---|
| 401 | V-14 | 0.9 | 0 | D | C | 0.007 | Comparison |
| 402 | " | " | 1 | A | A | 0.007 | Invention |
| 403 | " | " | 2 | A | A | 0.007 | " |
| 404 | " | " | 3 | A | A | 0.006 | " |
| 405 | " | 0.1 | 2 | C | A | 0.018 | Comparison |
| 406 | " | 0.2 | 2 | C | A | 0.014 | " |
| 407 | " | 0.3 | 2 | A | A | 0.010 | Invention |
| 408 | " | 0.6 | 2 | A | A | 0.009 | " |
| 409 | " | 0.9 | 2 | A | A | 0.007 | " |
| 410 | " | 1.2 | 2 | A | A | 0.005 | " |
| 411 | " | 1.5 | 2 | A | A | 0.004 | " |
| 412 | V-16 | 0.9 | 2 | A | A | 0.006 | " |
| 413 | V-100** | 0.9 | 0 | D | D | 0.008 | Comparison |
| 414 | " | 0.9 | 2 | C | C | 0.007 | " |
| 415 | V-101*** | 0.9 | 2 | A | A | 0.014 | " |

The superior effects of the present invention are now clearly proved by the results in Table 4.

EXAMPLE 5

A first subbing layer and a second subbing layer having the following formulations were coated in that order on both sides of a 100 μm thick biaxially-stretched polyethylene terephthalate film to prepare coated supports (Samples 501 to 522).

(1) First Subbing Layer Formulation

| | |
|---|---|
| Vinylidene chloride latex (shown in Table 5) | 15 parts |
| Compound H-1 | see Table 5 |
| Colloidal silica | see Table 5 |
| Polystyrene fine particles (average particle size: 3 μm) | 80 mg/m² |
| Distilled water | to make 100 parts |

-continued

| | |
|---|---|
| 10% KOH solution to adjust to a pH of 6 | |
| Coating Conditions: | |
| Coating composition temperature: | 10° C. |
| Dry film thickness: | see Table 5 |
| Drying conditions: | 180° C. × 2 mins. |

(2) Second Subbing Layer Formulation

| | |
|---|---|
| Gelatin | 1 part |
| Methyl cellulose | 0.05 part |
| 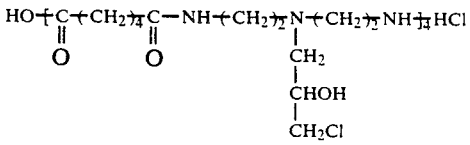 | 0.02 part |
| $C_{12}H_{25}O(CH_2CH_2O)_{10}H$ | 0.03 part |
| 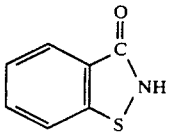 | 3.5 × 10⁻³ part |
| Acetic acid | 0.2 part |
| Water to make | 100 parts |

-continued

| Coating Conditions: |
|---|
| Coating composition temperature: 25° C. |
| Dry film thickness: 0.1 μm |
| Drying conditions: 170° C. × 2 mins. |

Coated supports (Sample No. 523 to 526) were prepared in the same manner, except for replacing Compound H-1 in the first subbing layer with the following compounds.

| Sample No. | Compound Added | Amount Added (part) |
|---|---|---|
| 523 | Sumitex Resin M-3 (made by Sumitomo Chemical Co., Ltd.) | 1 |
| 524 | Denacol EX 310 (made by Nagase Kasei K.K.) | 1 |
| 525 | 1,6-Hexamethylenediethyleneurea | 1 |
| 526 | $Mg(OH)_2$ | 1 |

A first silver halide emulsion layer, a second silver halide emulsion layer, a first protective layer, and a second protective layer in that order were coated and dried on one side of each of the resulting coated supports. A backing layer and a third protective layer in that order were coated and dried on the opposite side of the support. The formulations of these layers were the same as those used in Example 1.

The resulting samples were stored at 25° C. and 60% RH for 2 weeks and evaluated in the same manner as in Example 1. Adhesion at high humidity of the samples was also evaluated according to the following test method. The results of these evaluations are shown in Table 5 below.

Adhesion at High Humidity

After the sample was allowed to stand at 25° C. and 80% RH for 24 hours, the surface of the sample was hatched with a razor to reach the support surface by 7 parallel lines at 5 mm intervals in both the longitudinal and transverse directions to make 36 squares. An adhesive tape ("Nitto Tape" produced by Nitto Electric Industrial Co., Ltd.) was adhered on the crosshatched sample, and allowed to stand for at least 1.5 hours. The adhesive tape was rapidly stripped off at a peel angle of 180° in an atmosphere of 25° C. and 80% RH. The adhesion at high humidity was evaluated according to the following rating system.

A: At least 95% of the squares were not peeled off.

B: At least 90% and less than 95% of the squares were not peeled off.

C: At least 60% and less than 90% of the squares were not peeled off.

D: Less than 60% of the squares were not peeled off.

Samples rated "A" had an adhesion strength sufficient to withstand practical use as a photographic material. In Table 5, the asterisk has the same meaning as in Table 1.

TABLE 5

| Sample No. | Vinylidene Latex | Colloidal Silica (Amount) (%*) | Thickness of First Subbing Layer (μm) | Amount of H-1 (%*) | Dry Adhesion | Adhesion at High Humidity | Wet Adhesion | Rate of Dimensional Change with Processing (%) |
|---|---|---|---|---|---|---|---|---|
| 501 | V-13 | 0 | 0.9 | 0 | D | D | C | 0.006 |
| 502 | " | " | " | 1 | A | D | A | 0.007 |
| 503 | " | " | " | 2 | A | D | A | 0.007 |
| 504 | " | " | " | 3 | A | D | A | 0.006 |
| 505 | " | Snowtex 20 (3) | " | 0 | D | D | C | 0.007 |
| 506 | " | " | " | 1 | A | A | A | 0.006 |
| 507 | " | " | " | 2 | A | A | A | 0.006 |
| 508 | " | " | " | 3 | A | A | A | 0.006 |
| 509 | " | " | 0.1 | 2 | C | B | A | 0.017 |
| 510 | " | " | 0.2 | " | C | A | A | 0.014 |
| 511 | " | " | 0.3 | " | A | A | A | 0.009 |
| 512 | " | " | 0.6 | " | A | A | A | 0.008 |
| 513 | " | " | 0.9 | " | A | A | A | 0.006 |
| 514 | " | " | 1.2 | " | A | A | A | 0.005 |
| 515 | V-13 | Snowtex 20 (3) | 1.5 | 2 | A | A | A | 0.005 |
| 516 | V-15 | " | 0.9 | " | A | A | A | 0.006 |
| 517 | " | " | " | 0 | A | D | A | 0.005 |
| 518 | " | Snowtex 20 (1) | " | 2 | A | A | A | 0.006 |
| 519 | " | Snowtex 20 (3) | " | " | A | A | A | 0.006 |
| 520 | " | Snowtex 20 (5) | " | " | A | A | A | 0.007 |
| 521 | " | Snowtex 20 (10) | " | " | A | A | A | 0.010 |
| 522 | " | Snowtex 20 (15) | " | " | A | A | A | 0.015 |
| 523 | V-13 | Snowtex 20 (3) | " | — | B | D | C | 0.013 |
| 524 | " | " | " | — | C | D | B | 0.012 |
| 525 | " | " | " | — | B | D | C | 0.010 |
| 526 | " | " | " | — | B | D | C | 0.007 |

Sample Nos. 501, 505, 509, 510, 517, and 523 to 526: Comparative samples

Sample Nos. 502 to 504, 506 to 508, 511 to 516 and 518 to 522: Samples of the present invention The results in Table 5 show that Samples 506 to 508, 511 to 516, and 518 to 522, in which colloidal silica had been added to samples of the present invention, exhibited markedly improved adhesion in a high humidity atmosphere.

EXAMPLE 6

A first subbing layer having the following formulation was coated on both sides of a 100 μm thick biaxially-stretched polyester film which had been subjected to a corona discharge treatment under the conditions shown below.

| Corona Discharge Treatment Conditions: |
|---|
| Width of Support: 30 cm |
| Running Speed of Support: 30 m/min |

-continued

| | |
|---|---|
| Electrode Gap: 1.8 mm | |
| Electric Power: 200 W | |
| First Subbing Layer Formulation: | |
| Vinylidene chloride latex (shown in Table 6) | 15 parts |
| Compound H-1 | see Table 6 |
| Colloidal silica | see Table 6 |
| Polystyrene fine particles (average particle size: 3 μm) | 80 mg/m$^2$ |
| 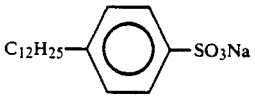 | 0.15 part |
| Distilled water to make | 100 parts |
| 10% KOH solution to adjust to a pH of 6 | |
| Coating Conditions: | |
| Coating composition temperature: 15° C. | |
| Dry film thickness: shown in Table 6 | |
| Drying conditions: 150° C. × 2 mins. | |

The surface of the thus formed first subbing layer was subjected to a corona discharge treatment under the same conditions as described above, and a second subbing layer having the same formulation as used in Example 1 was then coated thereon. The resulting coated supports were designated Samples 601 to 616.

A silver halide emulsion layer and a first protective layer were coated in that order on one side of the coated sample, while a backing layer and a second protective layer were coated on the other side in that order to obtain Samples 601 to 616. The formulations of these layers were the same as used in Example 2.

The resulting samples were stored at 25° C. and 60% RH for 1 week and then evaluated in the same manner as in Example 5. The results obtained are shown in Table 6 below. In Table 6, the asterisks have the same meaning as in Table 1.

TABLE 6

| Sample No. | Vinylidene Latex | Colloidal Silica (Amount) (%*) | Thickness of First Subbing Layer (μm) | Amount of H-1 (%*) | Dry Adhesion | Adhesion at High Humidity | Wet Adhesion | Rate of Dimensional Change with Processing (%) |
|---|---|---|---|---|---|---|---|---|
| 601 | V-13 | 0 | 0.9 | 0 | D | D | C | 0.006 |
| 602 | " | " | " | 1 | A | D | A | 0.006 |
| 603 | " | " | " | 2 | A | D | A | 0.006 |
| 604 | " | " | " | 3 | A | D | A | 0.007 |
| 605 | " | Snowtex ZL (1) | " | 2 | A | A | C | 0.006 |
| 606 | " | Snowtex ZL (3) | " | " | A | A | A | 0.006 |
| 607 | " | Snowtex ZL (5) | " | " | A | A | A | 0.007 |
| 608 | " | Snowtex ZL (10) | " | " | A | A | A | 0.010 |
| 609 | " | Snowtex ZL (15) | " | " | A | A | A | 0.015 |
| 610 | " | Snowtex ZL (3) | 0.1 | " | C | B | A | 0.018 |
| 611 | " | " | 0.3 | " | A | A | A | 0.010 |
| 612 | " | " | 0.6 | " | A | A | A | 0.009 |
| 613 | " | " | 1.2 | " | A | A | A | 0.005 |
| 614 | V-100** | " | 0.9 | 0 | D | D | D | 0.007 |
| 615 | " | " | " | 2 | B | B | C | 0.007 |
| 616 | V-101*** | " | " | " | A | A | A | 0.016 |

Sample Nos. 601 to 604, 610 and 614 to 616: Comparative samples
Sample Nos. 605 to 609 and 611 to 613: Samples of the present invention The results in Table 6 show that Samples 605 to 609 and 611 to 613, which are samples of the present invention containing colloidal silica, have markedly improved adhesion in a high humidity atmosphere.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a polyester support having a hydrophilic colloidal layer containing a polymer latex on at least one side thereof, wherein said polyester support has a subbing layer having a thickness of 0.3 μm or more and containing a vinylidene chloride copolymer composed of at least (1) from 70 to 99.9% by weight of a vinylidene chloride monomer and (2) from 0.1 to 5% by weight of a vinyl monomer having at least one carboxyl group, said subbing layer further containing a compound represented by formula (I) or (II):

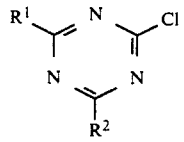

(I)

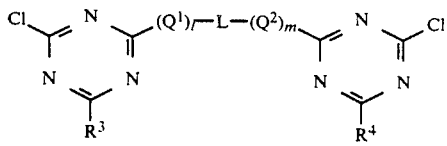

(II)

wherein $R^1$, $R^2$, $R^3$, and $R^4$ each represents a chlorine atom, a hydroxyl group, an alkyl group, an alkoxy group, an alkylthio group, —OM, wherein M represents a monovalent metal atom, —NR'R", or —NHCOR'", wherein R', R", and R'" each represents a hydrogen atom, an alkyl group, or an aryl group; $Q^1$ and $Q^2$ each represents —O—, —S—, or —NH—; L represents a divalent linking group selected from an alkylene group, an arylene group, and a combination thereof; and l and m each represents 0 or 1.

2. A silver halide photographic material as claimed in claim 1, wherein said vinylidene chloride copolymer is composed of at least (1) from 85 to 99% by weight of vinylidene chloride monomer and (2) from 0.1 to 5% by weight of a vinyl monomer having at least one carboxyl group.

3. A silver halide photographic material as claimed in claim 1, wherein $R^1$ represents a chlorine atom.

4. A silver halide photographic material as claimed in claim 1, wherein $R^2$, $R^3$ and $R^4$ each represents an alkoxy group, —OM, or —NR'R".

5. A silver halide photographic material as claimed in claim 4, wherein $R^2$, $R^3$ and $R^4$ each represents —OM.

6. A silver halide photographic material as claimed in claim 1, wherein L represents an alkylene group.

7. A silver halide photographic material as claimed in claim 1, wherein $Q^1$ and $Q^2$ each represents —O— or —NH—.

8. A silver halide photographic material as claimed in claim 1, wherein l and m each represents 1.

9. A silver halide photographic material as claimed in claim 1, wherein the compound represented by formula (I) or (II) is present in an amount from 0.1 to 10% by weight based on the vinylidene chloride copolymer.

10. A silver halide photographic material as claimed in claim 9, wherein the compound represented by formula (I) or (II) is present in an amount from 0.3 to 3% by weight based on the vinylidene chloride copolymer.

11. A silver halide photographic material as claimed in claim 1, wherein the subbing layer further contains colloidal silica.

12. A silver halide photographic material as claimed in claim 11, wherein the colloidal silica is present in an amount from 0.1 to 10% by weight on a dry basis based on the vinylidene chloride copolymer.

13. A silver halide photographic material as claimed in claim 12, wherein the colloidal silica is present in an amount from 1 to 5% by weight on a dry basis based on the vinylidene chloride copolymer.

14. A silver halide photographic material as claimed in claim 1, wherein the subbing layer has a thickness from 0.3 to 5 μm.

15. A silver halide photographic material as claimed in claim 14, wherein the subbing layer has a thickness from 0.4 to 1.5 μm.

16. A silver halide photographic material as claimed in claim 1, wherein the polyester support comprises polyethylene terephthalate.

17. A silver halide photographic material as claimed in claim 1, wherein the polyester support has a thickness from 12 to 500 μm.

18. A silver halide photographic material as claimed in claim 17, wherein the polyester support has a thickness from 40 to 200 μm.

19. A silver halide photographic material as claimed in claim 1, wherein the polymer latex is present at a dry weight ratio from 0.01 to 1.0 based on gelatin being used as a binder.

20. A silver halide photographic material as claimed in claim 19, wherein the polymer latex is present at a dry weight ratio from 0.1 to 0.8 based on gelatin being used as a binder.

* * * * *